United States Patent [19]

Sherby et al.

[11] Patent Number: 4,769,214

[45] Date of Patent: Sep. 6, 1988

[54] ULTRAHIGH CARBON STEELS CONTAINING ALUMINUM

[75] Inventors: Oleg D. Sherby, Palo Alto, Calif.; Dong W. Kum, Seoul, D.P.R. of Korea; Toshimasa Oyama, Palo Alto; Jeffrey Wadsworth, Menlo Park, both of Calif.

[73] Assignee: SPTek, Palo Alto, Calif.

[21] Appl. No.: 777,520

[22] Filed: Sep. 19, 1985

[51] Int. Cl.[4] ..... C22C 38/06

[52] U.S. Cl. ..... 420/77; 420/79; 420/100; 420/101; 420/103; 420/99; 148/334; 148/333; 148/320

[58] Field of Search ..... 75/124 R, 124 E, 124 F, 75/123 J, 126 R; 148/36, 12 C, 12 R

[56] References Cited

U.S. PATENT DOCUMENTS

| | | | |
|---|---|---|---|
| 1,763,421 | 1/1926 | Devries | 75/124 |
| 3,951,697 | 5/1976 | Sherby et al. | 148/12 R |
| 4,448,613 | 5/1984 | Sherby et al. | 148/12 R |
| 4,533,390 | 8/1985 | Sherby et al. | 148/36 |

FOREIGN PATENT DOCUMENTS

| | | | |
|---|---|---|---|
| 715636 | 2/1980 | U.S.S.R. | 75/124 |
| 863702 | 9/1981 | U.S.S.R. | 75/124 |

OTHER PUBLICATIONS

C. F. Jatczak, "Hardenability in High Carbon Steels", Oct. 1973 (Metallurgical Transactions, vol. 4, p. 2267).

Sherby and Wadsworth, "Damascus Steels", Feb 1985 (Scientific American, vol. 252, No. 2, p. 112).

Sherby et al., "Ultrahigh Carbon Steels" Jun. 1985 (Journal of Metals, vol. 37, No. 6, pp. 50–56).

Dong Wha Kum et al. "Superplastic Ultrahigh Carbon Steels" American Society for Metals reprint No. 8401-002 Mar. 1984.

*Primary Examiner*—Melvyn J. Andrews
*Assistant Examiner*—Deborah Yee
*Attorney, Agent, or Firm*—Gregory O. Garmong

[57] ABSTRACT

An ultrahigh carbon steel having a composition of carbon in an amount of from about 0.8 weight percent up to the maximum solubility limit of carbon in austenite, aluminum in an amount of from about 0.5 to about 10 weight percent, an effective amount of a stabilizing element acting to stabilize iron carbide against graphitization, and the balance iron. Preferably, the aluminum is present in an amount of from about 0.5 to about 6.4 weight percent and the stabilizing element is chromium. The steel has excellent ductility and is readily hot, warm and cold worked without cracking. It is particularly useful in superplastic forming operations, and may be processed to a suitable microstructure by any technique which reduces its grain size to about 10 microns or less, and preferably to about 1 micron. Such a very fine grain size is readily acheived with the steel, and the aluminum and stabilizing additions act to retain the fine grain size during superplastic processing.

18 Claims, 4 Drawing Sheets

ULTRAHIGH CARBON STEELS CONTAINING ALUMINUM

BACKGROUND OF THE INVENTION

The present invention relates to metal alloys, and, more particularly, to an ultrahigh carbon steel containing aluminum.

The simultaneous achievement of high strength, good ductility, microstructural stability and excellent workability are continuing objectives in the search for improved steels. While the first three properties are sometimes obtained, the compositions and microstructures needed to obtain these properties often involve particles or other microstructural features which preclude excellent workability. Steels are usually cast as thick sections and reduced by rolling or forging steps. If the steel is insufficiently workable, it may develop cracks during reduction which render the final product unacceptable. It is also essential for a commercial steel that the desired properties be obtained with relatively inexpensive alloying additions and through processing steps which are straightforward and compatible with existing steel mill processing techniques.

The selection and processing of steels also requires due consideration of the end use of the steel. In many applications a uniform, fine-scale microstructure is known to be a necessity. In particular, the manufacturing technique of superplastic forming has received widespread attention, because in many cases parts may be formed to essentially their final shape in a single step. Material costs and costs of secondary processing such as machining may therefore be significantly reduced. Superplastic behavior is usually found in metals having very fine grain sizes at elevated temperatures, and is marked by a high sensitivity of the stress to strain rate during deformation.

The selection of alloying additions and processing procedures therefore requires consideration of the fabrication technique, as well as the ultimate properties needed in the finished end product. Conventionally processed materials require acceptable workability during fabrication. The requirements in specialized processing operations such as superplastic forming are even more stringent.

To prepare an alloy for a superplastic forming operation, the alloy must first be reduced in section and processed to a fine grain structure. Although in some cases superplasticity is not related to grain size, in most instances a finer grain size results in increased superplastic strain rate for any selected stress level. Most alloys must therefore first be processed to a fine grain size which is stable when the alloy is heated for superplastic forming. If the fine grain size is not sufficiently stabilized, the grains coarsen so much during the superplastic forming operation that the superplastic characteristic is lost before forming is completed, and the forming operation fails. Thus, stabilization of fine grain structures and increased superplastic forming rate are keys to improving superplastic fabrication operations.

Most of the commercial-scale applications of superplastic forming have utilized titanium, nickel, and aluminum alloys of interest in the aerospace industry. Iron-based superplastic alloys have also been developed, including, for example, the ultrahigh carbon steel disclosed in U.S. Pat. No. 3,951,697. This patent relates to a process for preparing a hypereutectoid steel having a fine grain size and an array of fine iron carbides to stabilize the fine grain size during subsequent superplastic processing. The superplastic forming is then accomplished just below the eutectoid (or $A_1$) temperature of about 725° C., since the steel does not exhibit the desirable superplastic property below about 600° C. or above about 750° C.

While the ultrahigh carbon steel represents a significant advance in the art, problems remain in its economic application on an industrial scale. When the steel is heated to the warm and hot working range, the fine iron carbides tend to coarsen, with the result that the fine grains also grow to larger sizes. Since a fine grain size is required for superplasticity, the growth of the grains may result in the loss of the superplastic property, even though the steel is heated to the appropriate temperature range. The superplastic forming operation must be completed before the grains grow too large. In some cases, the processing cannot be completed because the grains coarsen to a size such that superplasticity is lost, thereby making the superplastic forming operation commercially impractical.

An important consequence of the increase in grain size during heating in superplastic processing is a reduction in the allowable superplastic forming strain rate. Studies and calculations have shown that an increase in grain size from about 1 micrometer to about 5 micrometers can be expected to reduce the superplastic strain rate at constant stress by about a factor of 100. Since a high strain rate results in a short forming time, grain size coarsening is expected to increase drastically the time required to form a part.

One approach to an improved ultrahigh carbon steel, wherein additions of silicon and a carbide stabilizing element are made, is described in U.S. Pat. No. 4,533,390. The ultrahigh carbon steel containing silicon and a carbide stabilizer may be processed to include a stable array of iron carbide particles which act to retain the fine grain size during subsequent processing, and to increase the eutectoid temperature. The result is that superplastic processing of this material may proceed at higher strain rates and lower stress levels than used for plain carbon ultrahigh carbon steels. This steel provides an important advance, but has limitations in practical application. For higher contents of silicon, hot and warm working of such steels becomes difficult due to edge and surface cracks which occur during processing. The ductility of such steels is also limited at ambient temperatures, with cracks appearing after about 20 percent reduction in rolling.

Consequently, there has been a need for an improved iron-based alloy having enhanced ductility during hot, warm and cold working, as well as a stable, fine grain size at elevated temperatures for superplastic formability. Such improved ductility is important both in the end use and also in the processing operations required to reduce the thickness and produce the fine, stable grain size. Desirably, such an alloy would also have increased superplastic forming strain rates to enhance the economics of commercial superplastic forming operations. The present invention fulfills this need, and further provides related advantages.

SUMMARY OF THE INVENTION

The present invention is embodied in an improved ultrahigh carbon steel which is strong, ductile, highly workable at hot, warm and ambient temperatures, oxidation resistant during hot and warm working, and may be readily processed to a fine microstructure. The fine microstructure is stabilized and maintained by an array of stable particles. The steel has excellent workability in conventional processing procedures, and in addition has excellent strength, hardness and ductility as an end product. Consequently, whatever the processing technique chosen to produce the end product, superior properties result. Fabrication techniques to produce the fine, stable microstructure are simplified, reducing the cost of primary fabrication procedures.

The steel in accordance with the invention has superplastic elongations of over 1000 percent, when deformed at 775° C. and strain rates on the order of 1.6 percent per second. There are indications of superplastic behavior at strain rates as high as 15 percent per second. The steel therefore exhibits the important combination of stabilized fine grain size and increased superplastic forming strain rates, so that highly complex parts may be superplastically formed. Accordingly, the steel of the invention further broadens the range of commercially feasible superplastic forming operations and articles that may be formed thereby.

The steel also exhibits excellent cold workability. For example, as much as 70% cold rolling can be performed with no edge cracking. This cold workability permits the ready attainment of highly dimensionally accurate sheet material. This high degree of cold workability is not attainable in ultrahigh carbon steel containing silicon.

In accordance with the invention, aluminum is utilized as a primary alloying ingredient in an ultrahigh carbon steel. Specifically, an iron-based alloy consists essentially of carbon in an amount of from about 0.8 weight percent up to the maximum solubility limit of carbon in austenite, aluminum in an amount of from about 0.5 up to about 10 weight percent, an effective amount of a stabilizing element acting to stabilize iron carbides against graphitization in the presence of aluminum, and the balance iron. Preferably, the stabilizing element is selected from the group consisting of chromium and molybdenum, and, most preferably, the stabilizing element is chromium in an amount of from about 0.5 to about 2 percent. Manganese may also be present, as in most steels, in an amount of about 0.5 weight percent. The present invention also provides a process for preparing such a material with a fine stabilized microstructure.

Preferably, the aluminum is present in an amount of from about 0.5 to about 6.4 weight percent, most preferably about 1.6 weight percent. It is also desirable that the carbon content be maintained above about 1.0 weight percent to provide a sufficiently high volume fraction of iron carbide particles to stabilize the fine grain size.

In accordance with another aspect of the invention, the ultrahigh carbon steel may be processed to a form suitable for further superplastic processing by any technique which produces a stable grain structure having a grain size of less than about 10 micrometers, preferably from about 1 to about 2 micrometers, and most preferably about 1 micrometer. Examples of such processing techniques include the processes disclosed in U.S. Pat. Nos. 3,951,697, 4,448,613, and 4,533,390, whose disclosures are herein incorporated by reference.

It will be appreciated from the foregoing that the present invention represents an important advance in the technology of steels. The steel of the invention is readily processed to a fine, stabilized microstructure which exhibits excellent workability during primary fabrication procedures and high ductility as an end product. The steel also is superplastically formable at high strain rates and is stable in superplastic forming for extended periods of time, these two factors allowing increased flexibility in complex commercial superplastic forming operations. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

In accordance with the invention, an ultrahigh carbon steel consists essentially of carbon in an amount of from about 0.8 weight percent up to the maximum solubility limit of carbon in austenite, aluminum in an amount of from about 0.5 up to about 10 weight percent, an effective amount of a stabilizing element acting to stabilize iron carbides against graphitization in the presence of aluminum, balance iron totalling 100 weight percent. The alloy may also contain minor amounts of impurities customarily found in commercial steels, such as manganese, nickel, vanadium and copper. Carbon may be present up to its maximum solubility limit in austenite. The stabilizing element is preferably selected from the group consisting of chromium and molybdenum. Preferably, the aluminum is present in an amount of about 0.5 to about 6.4 weight percent, and most preferably in an amount of about 1.6 weight percent. The stabilizing element is most preferably chromium, in an amount of about 1.5 weight percent. The most preferred composition of the steel is about 1.3 weight percent carbon, about 1.6 weight percent aluminum, about 1.5 weight percent chromium, with the balance iron totalling 100 percent.

As used herein, a "steel" is an iron-based (also termed ferrous) alloy containing carbon and other alloying additions. Such a steel, besides containing alloying ingredients in accordance with the invention, may contain elements customarily found in commercial steels, such as manganese, in amounts that do not prevent attainment of the desirable properties afforded by the alloy of the present invention.

The steel is melted using conventional melting practices. The steel may be air-melted, or vacuum melted if particular cleanliness is desired. The steel may then be discontinuously cast into ingots or continuously cast into slabs or other forms.

Figure 1:
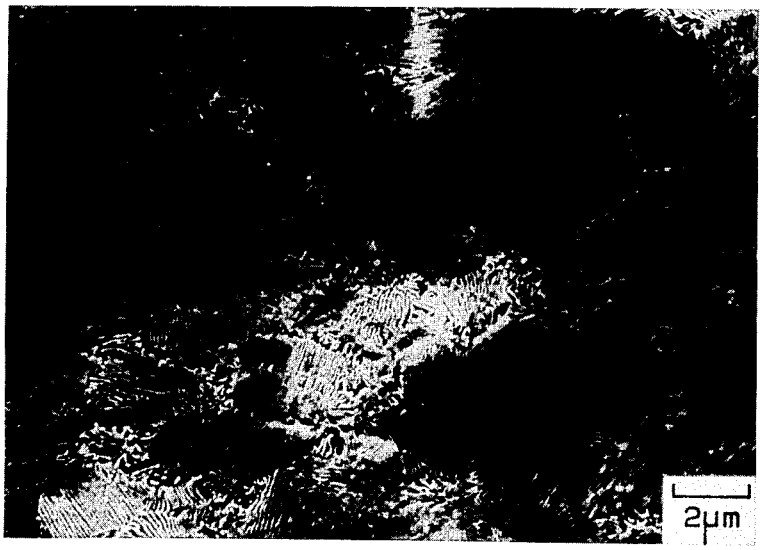
FIG. 1 is a scanning electron micrograph of the microstructure of an ultrahigh carbon steel containing aluminum after initial thermo-mechanical processing by hot and warm working, with the final deformation step occurring above the $A_1$ transformation temperature.
Figure 1:
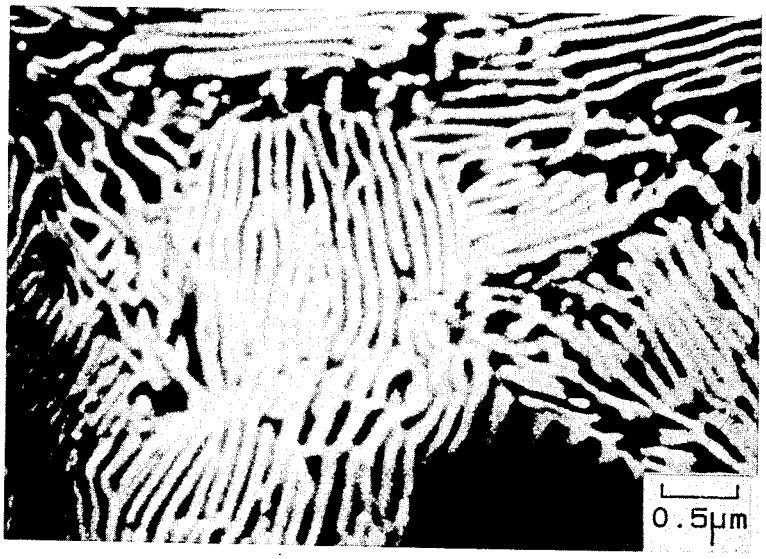

A fine microstructure is developed by mechanically working the as-cast material, preferably in a process involving hot and warm working with the final deformation step occurring just above the $A_1$ temperature. For example, such a process might involve a series of hot working steps at temperatures from about 1100° C. to about 700° C. (As used herein, hot working is mechanical working in the temperature range above about $\frac{2}{3}$ Tm, where Tm is the absolute melting temperature of the alloy. For ferrous alloys, hot working is accomplished in the range of about 950° C. to about 1450° C. Warm working is mechanical working in the temperature range between about $\frac{1}{3}$ Tm and about $\frac{2}{3}$ Tm. For ferrous alloys, this warm working is accomplished in the range of about 350° C. to about 950° C.) FIG. 1 illustrates the microstructure obtained by hot and warm rolling and air cooling such a steel, by the procedure set forth in Example 1. The microstructure has fine pearlite colonies about 3–5 micrometers in size, with ultra fine lamellar spacings between cementite plates of about 0.1 micrometers. Proeutectoid carbides are evenly distributed in the pearlite matrix as very fine particles. It is believed that the presence of aluminum contributes to this even distribution of proeutectoid carbides during hot and warm working. The hot and warm worked and air cooled steel has high strength and hardness, with good ductility at ambient temperatures. This steel may be used directly for many applications, without further processing.

Figure 2:
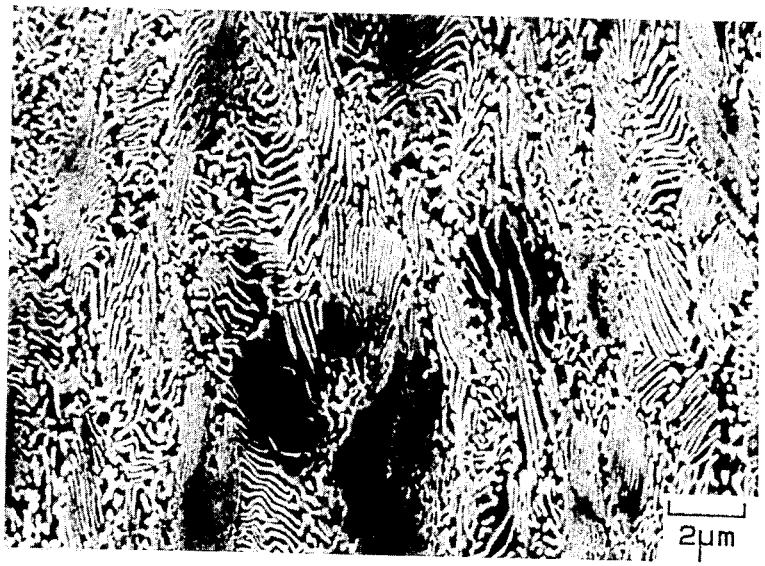
FIG. 2 is a scanning electron micrograph of the microstructure of an ultrahigh carbon steel containing aluminum after initial thermo-mechanical processing by hot and warm working, with the final deformation step occurring below the $A_1$ transformation temperature.

A fine microstructure may also be obtained by hot and warm working of the as-cast material, with the final deformation step occurring below the $A_1$ temperature. FIG. 2 illustrates the microstructure of such a steel, processed in the manner described in Example 5. The microstructure shown in FIG. 2 is generally similar to that of FIG. 1, except that the pearlite colonies are elongated in the direction of rolling, as the final finishing passes were below the $A_1$ temperature. Even without further annealing, the hot and warm worked steel exhibits high strength and reasonable ductility.

Figure 3:
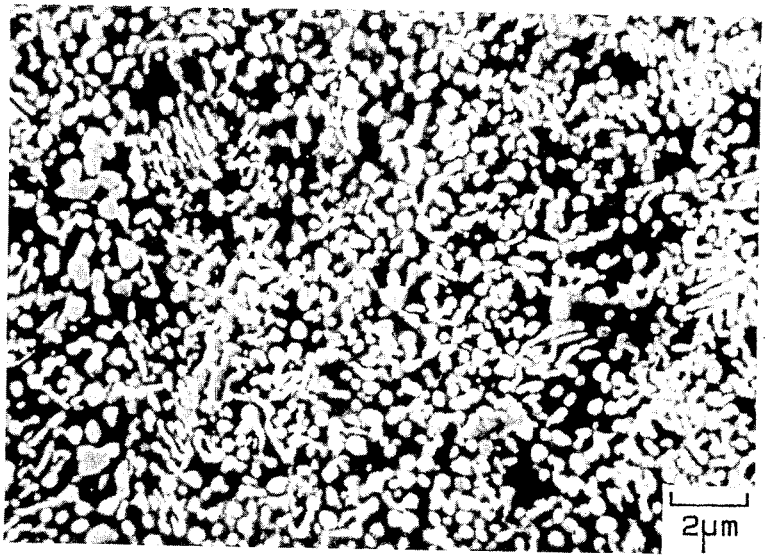
FIG. 3 is a scanning electron micrograph of the microstructure of an ultrahigh carbon steel containing aluminum aftrer hot and warm working above the $A_1$ transformation temperature, air cooling, cold working, and annealing to obtain a spheroidized microstructure.
Figure 4:
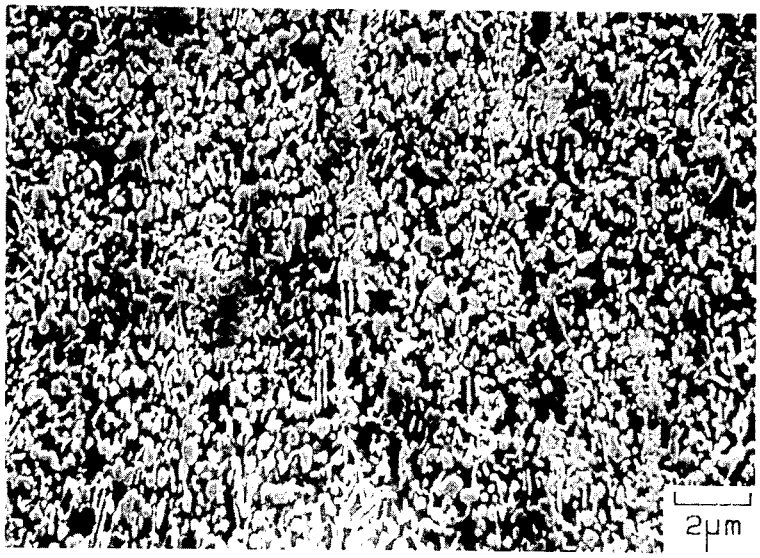
FIG. 4 is a scanning electron micrograph of the microstructure of an ultrahigh carbon steel containing aluminum after hot and warm working above the $A_1$ transformation temperature, air cooling, reheating to above the $A_1$ transformation temperature, and processing by a divorced eutectoid transformation with associated deformation, to obtain a spheroidized microstructure.

The hot and warm worked steel may then be readily converted into a spheroidized microstructure which is desirable for many end use applciations, since the spheroidized structure has enhanced machinability and ambient temperature tensile ductility. A spheroidized structure is also particularly desirable for achieving superplastic properties in subsequent superplastic forming operations. A spheroidized structure is obtained by simpler processing procedures than used for prior art steels, which often require a prolonged heat treatment with complex thermal cycling to attain a fine spheroidized structure. The steel of Example 6 was annealed for 45 minutes at 750° C., a temperature below the $A_1$ temperature, to produce the microstructure shown in FIG. 5. For a steel processed as described in Example 1, the spheroidized structure shown in FIG. 3 was obtained by cold working followed by annealing for 45 minutes at 750° C. Alternatively, a fine spheroidized microstructure is obtained by processing utilizing a divorced eutectoid transformation or a divorced eutectoid transformation with associated deformation, as described below. In each type of processing, a spheroidized, ultra fine ferrite grain size material is obtained, with the ferrite grains stabilized by the presence of iron carbide particles. An example of such a microstructure is shown in FIG. 4. The resulting spheroidized steel may be cold rolled extensively without edge cracking, and has excellent tensile elongation and strength at ambient temperature.

The previously described processing procedures produce a spheroidized microstructure suitable for superplastic forming, but other techniques may be utilized to prepare a steel suitable for superplastic forming. For use in superplastic processing operations, it is often desirable, but not always necessary, to first process the steel to a form having a distribution of fine grains with an array of carbide particles in the grain boundaries to inhibit growth of the grains. In this procedure, the processing technique should produce a stable grain structure having an average grain size of less than about 10 micrometers, preferably from about 1 to about 2 micrometers, and most preferably about 1 micrometer.

A number of processing techniques are known to produce a steel having such a fine grain structure and an array of carbide particles suitable for further superplastic processing, in addition to those just described, and the alloy of the present invention may be used in conjunction with any such processing technique. An example of a suitable processing technique is disclosed in U.S. Pat. No. 3,951,697. As disclosed therein, one approach to preparing such a fine grain structure is by heating to a temperature of from about 500° C. to about 900° C., and then mechanically working the steel with sufficient deformation to refine the grain size and spheroidize the predominant portion of the iron carbide. Optionally, the process may also include homogenization and mechanical working of the steel at a temperature of from about 1100° C. to about 1150° C. prior to working in the range of from about 500° C. to about 900° C.

In another approach, a fine grain material may be produced by a process including a divorced eutectoid transformation or a divorced eutectoid transformation with associated deformation, as disclosed in U.S. Pat. No. 4,448,613.

Briefly, a process for preparing a fine grain structure through divorced eutectoid transformation processing begins with heating the steel to a temperature in excess of the $A_{cm}$ transformation temperature, to form an austenite matrix in which substantially all of the carbon is dissolved. The steel is cooled to about the $A_1$ transformation temperature, while deforming the steel as by rolling or forging during at least part of the cooling procedure, to refine the austenite grain size. The steel is further cooled to below the $A_1$ transformation temperature to transform the structure to a mixture of pearlite and pro-eutectoid carbide particles. The steel is reheated to a soaking temperature approximately 50° C.

above the $A_1$ temperature, and held at that temperature for a time sufficient to dissolve the carbides into the austenite, in which the carbon is not uniformly distributed. The holding time depends upon the exact composition of the steel and the temperature chosen, but is typically in the range of a few minutes to one hour. Finally, the steel is cooled at a rate equivalent to air cooling to below the $A_1$ transformation temperature. Alternatively, the same processing procedure may be followed, but with mechanical working during the step wherein the dissolved carbon is not yet uniformly distributed in the austenite matrix, and possibly mechanical working as the steel is cooled below the $A_1$ temperature. This process variation is known as a divorced eutectoid transformation with associated deformation. Either approach results in a fine ferrite grain structure with an array of fine iron carbide particles in the grain boundaries serving to stabilize the grains against subsequent coarsening.

It is emphasized that the processing procedures described above for producing a fine grain ferrite structure having an array of iron carbide particles are intended to be exemplary. Other techniques for producing such structures are also suitable.

If the steel processed to a fine grain size is to be utilized in superplastic forming, the subsequent superplastic forming step may be performed by any suitable process. In such processes, the steel is heated in an appropriate apparatus to its superplastic temperature range at about the $A_1$ temperature. In the steel of the invention, the addition of aluminum increases the $A_1$ temperature, so that superplastic processing is preferably accomplished at a temperature of from about 700° C. to about 900° C., and most preferably at a temperature of about 790° C. As will be described subsequently, higher aluminum contents increase the $A_1$ temperature, thereby increasing the maximum superplastic processing temperature. An increased superplastic processing temperature is desirable, if the stable structure is retained, to increase the maximum strain rate for superplastic forming. In addition, the increased superplastic processing temperature reduces the steel flow stress and thence the machinery power requirements.

The superplastic deformation may be accomplished with tooling, such as press forming in open or closed dies. The increased $A_1$ temperature reduces the stress required for superplastic deformation, so that superplastic forming techniques previously not thought suitable for use with steel alloys may also be utilized. For example, in blow forming a superplastic steel sheet is forced into a female mold cavity under an applied gas pressure. The applied gas pressure forces the sheet into the cavities of the mold without the need for complicated male tooling and with a pressure which is continuously and uniformly applied. Blow forming has been employed mainly for titanium and aluminum based superplastic alloys, but not widely for ferrous alloys. Except for the silicon-containing steel disclosed in U.S. Pat. No. 4,533,390, the greater strengths of the prior iron-based superplastic alloys required excessively high gas pressures. The transformation temperatures and superplastic strain rates obtainable with the present steels are highly conducive to the use of blow forming techniques.

A fine grain structure should be retained, throughout the entire superplastic forming operation at elevated temperature, for this processing technique to be successful. Although the values of grain size may vary somewhat in various circumstances, for ferrous alloys little superplasticity is found, at conventional strain rates, when the grain size is larger than about 10 microns. Good superplasticity is observed at a grain size of about 2 micrometers, while a decrease of the grain size to about 1 micrometer results in an increased maximum superplastic strain rate.

Because the superplastic forming operation occurs at elevated temperature, the grains tend to coarsen with increased temperature and exposure time at temperature, and this coarsening is accelerated by the simultaneous superplastic deformation. To stabilize the grains against grain growth at elevated temperature, a fine dispersion of iron carbide particles is provided by the initial working operation, forming an array of pinning sites in the grain boundaries.

At elevated temperatures the fine particles are themselves unstable and tend to coarsen, with the result that the grains also coarsen. It is believed that the aluminum addition of the present invention retards the coarsening of the iron carbide particles by increasing the activity of carbon in ferrite. The rate of dissolution of the carbide particles is thereby reduced, so that the array of fine iron carbide particles does not coarsen as rapidly as would otherwise be expected. The aluminum has the added benefit of raising the $A_1$ temperature, thereby raising the temperature range for superplastic processing.

The addition of a large amount of aluminum by itself has undesirable side effects. The presence of aluminum accelerates the graphitization of the iron carbide. Iron carbide ($Fe_3C$) is not the lowest energy state of carbon in iron, so that over long periods of time the iron carbide tends to decompose to iron and graphite. In the absence of large amounts of aluminum, this decomposition normally occurs over a period of many years, even at elevated temperatures. However, in the presence of aluminum the graphitization is accelerated and may occur in a period of minutes or hours at the superplastic forming temperature. Graphitization is undesirable in that the transformation is accompanied by a reduction in the volume fraction of second phase iron carbide particles, thereby reducing their effectiveness in stabilizing the fine grain size. The stabilizing effect of the particles on the fine grains decreases with decreasing volume fraction of particles.

A stabilizing element is provided to stabilize the iron carbide against graphitization in the presence of aluminum. Suitable stabilizing elements include, for example, chromium, molybdenum, tungsten, and titanium. Chromium and molybdenum are preferred to titanium and tungsten as stabilizing elements, as it is believed that titanium and tungsten form very hard carbides which are essentially undeformable and may lead to cracking at the particle-matrix interface. By contrast, chromium and molybdenum form carbides with iron and carbon which are more deformable. Chromium is preferred to molybdenum because chromium carbides are generally more deformable than molybdenum carbides, and because of the presently lower price of chromium. Although applicants do not wish to be bound by this possible explanation, in the case of the preferred chromium stabilizing element, it is believed that the chromium stabilizes the particle size by changing its composition from iron carbide ($Fe_3C$) to an iron chromium carbide $(FeCr)_3C$. This iron-chromium carbide is more stable to graphitization at elevated temperatures than is the iron carbide, so that even in the presence of aluminum the carbide phase is resistant to graphitization. Chromium also aids in raising the $A_1$ temperature, contributing to an increased temperature range for superplastic forming.

The aluminum content of the steel should be greater than about 0.5 weight percent, and less than about 10 weight percent, preferably less than about 6.4 weight percent. Although aluminum in amounts less than about 0.5 weight percent may have a beneficial effect on the retarding of coarsening of the iron carbide particles, the increase in the $A_1$ temperature becomes significant only at aluminum levels of greater than about 0.5 weight percent.

For aluminum contents greater than about 10 percent, ordering in the iron-aluminum lattice is observed, with the associated formation of compounds such as iron aluminides ($Fe_3Al$). Ordering is detrimental to the ambient temperature mechanical properties, and results in reduced tensile ductility at all strain rates. By contrast, in the iron-silicon superplastic steel disclosed in U.S. Pat. No. 4,533,390, iron-silicon ordering begins at silicon contents of greater than about 3 weight percent, so that the ambient temperature tensile ductility of iron-silicon alloys is reduced with silicon contents greater than about 3 percent by weight. Thus, aluminum is a far more forgiving alloying addition than is silicon, and higher amounts of aluminum may be added to the steel without a consequential loss in low temperature ductility. The higher potential aluminum content also increases the $A_1$ temperature to a level greater than that achievable with a silicon addition, so that superplastic forming may be accomplished at significantly higher temperatures.

It is preferred that the aluminum content not exceed about 6.4 weight percent. With higher percentages of aluminum, hot and warm working become difficult. For aluminum content above about 10 percent, some edge cracking is observed. Typical carbon contents of the present steels are from about 0.8 to about 1.2 percent carbon, so that a sufficient volume fraction of carbides is present to stabilize the fine grain size at elevated temperature. In order to achieve good ductility at room temperature, the carbides must be distributed uniformly in the ferrite matrix. This microstructure is achieved by thermomechanical processing of the steel after soaking at a temperature where all the carbides are dissolved in the austenite. If too high an aluminum and carbon content is present, all of the carbides are not dissolved in the austenite, and the undissolved carbides are coarse and detrimental to the ambient and elevated temperature ductility.

Figure 6:
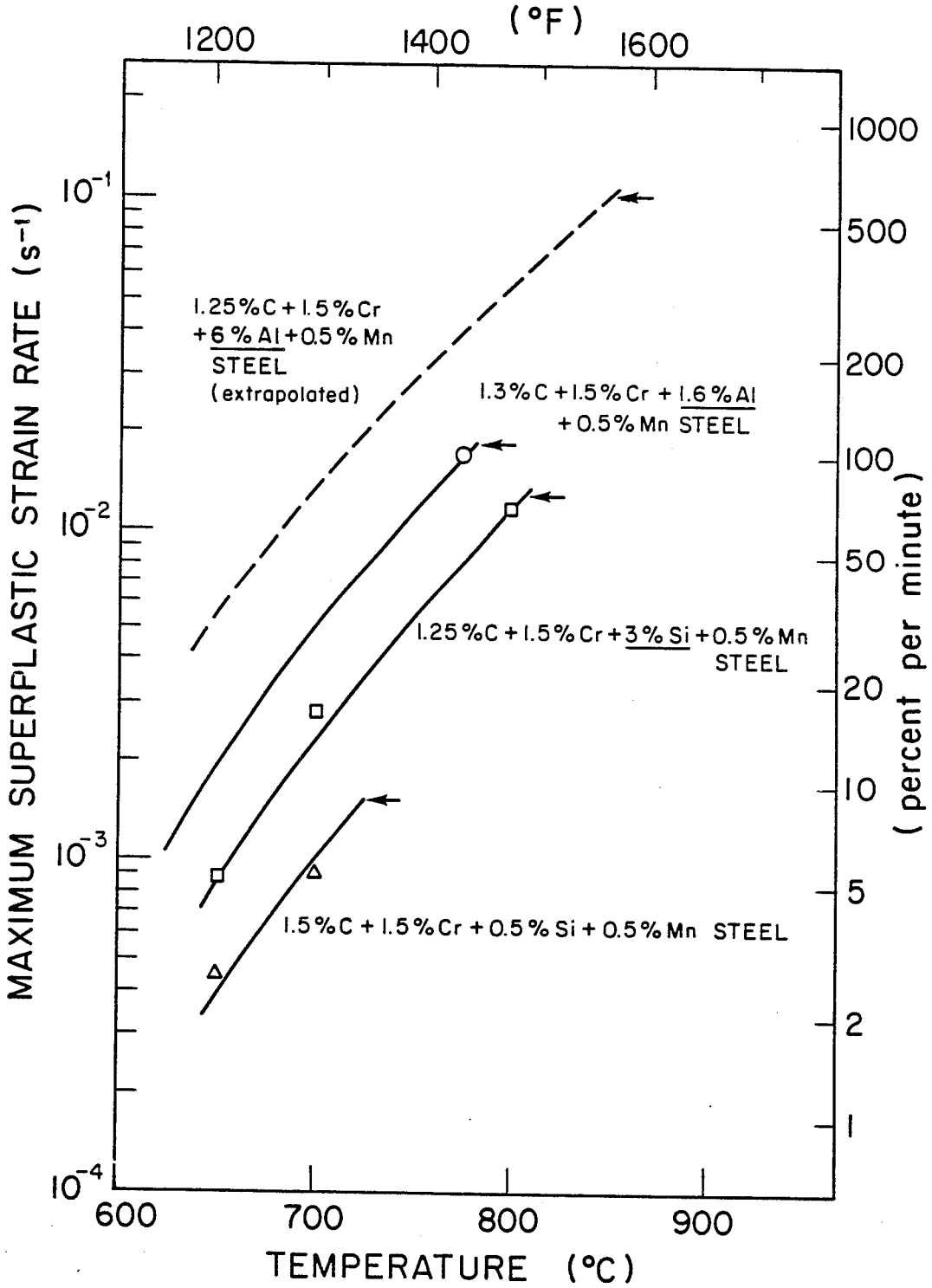
FIG. 6 is a graph of the maximum superplastic strain rate for an ultrahigh carbon steel, an ultrahigh carbon steel containing silicon, and an ultrahigh carbon steel containing aluminum, all of the steels containing about 1.5 weight percent chromium.

The use of aluminum results in several important advantages not obtainable in plain carbon or silicon-containing ultrahigh carbon steels. FIG. 6 presents the maximum strain rate for superplastic flow as a function of temperature for the three classes of steels, including two different aluminum-containing steels. The aluminum-containing steels have a maximum strain rate about an order of magnitude greater than the plain carbon ultrahigh carbon steel, at a selected temperature such as 700° C. where all three may be superplastically formed. This improvement is believed to result from the greater ability of aluminum to aid in retaining the fine ferrite grain size.

The addition of aluminum also raises the $A_1$ temperature of the steel, thereby raising the maximum temperature at which ferrite is stable and the maximum superplastic forming temperature. The horizontal arrow at the upper end of each line in FIG. 6 indicates the effective maximum temperature of ferrite stability and hence superplastic forming temperature. For plain carbon steels, this maximum temperature is the eutectoid temperature of about 725° C. A silicon addition stabilizes the ferrite, thus raising the maximum superplastic forming temperature. Using 3 percent silicon, the maximum temperature is about 810° C. Although larger amounts of silicon would result in larger increases, further silicon additions are not practical due to the associated decrease in workability of the steel and cracking during rolling. An aluminum addition also raises the maximum superplastic forming temperature. The line for 1.6 percent aluminum indicates that the maximum superplastic forming temperature is about 780° C. for this aluminum content. However, as pointed out above, larger amounts of aluminum may be added without detrimental effects on carbide stability or embrittling effects during mechanical working. For example, in a 6 percent aluminum steel the maximum ferrite and superplastic forming temperature should be raised to about 840° C. without deleterious effects on microstructure, workability or ambient temperature ductility. FIG. 6 shows that the maximum strain rate would be raised to nearly 10 percent per second. Such a high strain rate for superplasticity has never been previously achieved in any commercial superplastic ferrous material. It is nearly 10 times the rate previously obtained in superplastically formable ultrahigh carbon steels. Such a high strain rate also implies less elevated temperature exposure for a part during superplastic forming, so that less microstructural degradation is expected during the forming of a part.

The use of aluminum as an alloying addition has additional benefits of broader significance than the improvement of superplastic properties. The proeutectoid carbides in the steels of the invention are very fine and well distributed, as shown in the figures. Other ultra high carbon hypereutectoid steels tend to have proeutectoid carbides preferentially located at prior austenite grain boundaries, leading to an inhomogeneous distribution. The distribution of the proeutectoid carbides in the steels of the present invention is thought to contribute to the improved ambient temperature properties.

The hardenability of the ultrahigh carbon steels of the present invention is improved considerably over that observed for plain carbon ultrahigh carbon steels. A critical bar diameter of 0.95 inches (for 90 percent martensite at the center of the bar upon water quenching) is obtained in an ultrahigh carbon steel containing 1.6 weight percent aluminum, 1.5 weight percent chromium and 1.25 weight percent carbon. In contrast, in a plain carbon ultrahigh carbon steel, the corresponding critical bar diameter is 0.26 inches.

The high aluminum content also imparts to the steel improved oxidation resistance at elevated temperature, an important consideration in avoiding excessive oxidation during primary processing or superplastic processing. A sample of hot and warm forged steel containing 10 weight percent aluminum, 1.5 weight percent chromium and 1.25 weight percent carbon was heated in air to 850° C. for 20 minutes. Virtually no oxidation, and only a very light stain, was observed on the exposed surface.

Moreover, the cold working properties of the present steels are significantly better than previously observed in ultra high carbon, hypereutectoid steels. The microstructure of the hot and warm worked steels of the present invention is fine pearlite colonies of a size of from about 2 to about 10 micrometers with spacings between the pearlite platelets of less than about 0.1 micrometers. The resulting steels have Rockwell C hardness of about 40–50, but may still be cold rolled extensively without edge cracking. A steel in accordance with the invention, having 1.6 weight percent aluminum and 0.25 weight percent molybdenum, could be cold rolled to a reduction in thickness of 79% before any edge cracking was observed. The present steels can also be hot and warm rolled extensively without cracking. These improved properties could not be predicted from the behavior of prior steels, including the ultra high carbon, hypereutectoid steels containing silicon.

Aluminum addition to ultrahigh carbon steels gives the added benefit of making it possible to obtain spheroidized structures by simple and economical thermo-mechanical processing procedures. Spheroidized structures are often desirable because this structure is ideal for improving machinability and for improving cold workability. The spheroidized condition is readily achieved because the $A_1$ temperature is increased by aluminum additions. For example, a UHC steel containing 6.4 weight percent aluminum and 1.5 weight percent chromium has an $A_1$ temperature of 840° C. Hot and warm rolling such a steel repeatedly as it cools from 1150° to 750° C. results in small pearlite colonies with proeutectoid carbides uniformly distributed in the pearlite matrix. Since deformation was imparted to the steel between 840° C. and 750° C., the pearlite is heavily deformed and contains a high dislocation density. The hardness of the hot and warm worked steel is about 45 Rockwell C. When the steel is then heated to 830° C. for 20 minutes, the structure is fully spheroidized and the hardness is reduced to 30 Rockwell C. This structure results from the large driving force for spheroidization arising from the deformed pearlite and from the fact that spheroidization can now be performed at an unusually high temperature which is still below the $A_1$ temperature because of the aluminum addition. It is for these reasons that the same procedure cannot be used in a plain carbon UHC steel to achieve a spheroidized state. In the case of plain carbon, UHC steels, the low $A_1$ temperature (727° C.) does not permit extensive warm working below the $A_1$ temperature in a production operation. Furthermore, because of the low $A_1$ temperature, spheroidization treatments have to be conducted at relatively low temperatures (less than 727° C.) and therefore require prolonged expensive heat treatments.

The carbon content is chosen to lie between about 0.8 weight percent and the carbon content corresponding to the maximum solubility limit of carbon in austenite. This maximum solubility limit is not fixed, but varies according to the type and amount of other alloying elements present. Below about 0.8 weight percent carbon, an insufficient volume fraction of iron carbides is formed, so that the ferrite grain structure is not stabilized. At carbon contents above the maximum solubility limit, large, blocky iron carbide particles are retained from the treatment in the austenitizing range, resulting in decreased ductility of the final product. Preferably, the carbon content is greater than 1 weight percent to provide a high volume fraction of iron carbide precipitate.

The stabilizing element is provided in an amount sufficient to stabilize the iron carbide against graphitization in the presence of aluminum. In the most preferred embodiment wherein chromium is used as the stabilizing element, very slight but acceptable amounts of graphitization are observed after superplastically forming an alloy having 1.3 weight percent carbon, 1.6 weight percent aluminum, 1.5 weight percent chromium, and 0.5 weight percent manganese, with the balance iron. It is believed that a chromium content of substantially less than 0.5 weight percent is insufficient to provide the necessary stabilizing of the particles against graphitization. A molybdenum addition below about 0.1 weight percent is also expected to be insufficient to stabilize the particles against graphitization. Additions of the stabilizing elements substantially above the minimum required for stabilization are not expected to have significant beneficial effects, and may be detrimental in forming other phases in the steel. Chromium should not be added in an amount greater than about 2 weight percent, as a larger addition would tend to result in hard carbides detrimental to workability and formability. For the same reason, molybdenum may not be added in an amount greater than about 0.4 weight percent. The higher amounts of stabilizers are appropriate for higher carbon and aluminum contents.

The following examples are intended to illustrate aspects of the invention, but should not be taken as limiting the scope of the invention in any respect.

EXAMPLE 1

An ultrahigh carbon steel casting of the following composition was prepared by vacuum melting: 1.3 weight percent carbon, 1.6 weight percent aluminum, 0.6 weight percent manganese, 1.5 weight percent chromium, balance iron. A 2-inch thick billet of the casting was soaked at 1150° C. for 4 hours and then hot and warm worked by rolling continuously while cooling, in 8 passes to a final thickness of 0.27 inches. There was no cracking during rolling. The temperature at the final pass was about 850° C., i.e., above the $A_1$ temperature. The steel was air cooled to ambient temperature after rolling. The microstructure exhibited fine pearlite colonies, about 2–5 micrometers in size, with ultra fine lamellar spacing between cementite plates of about 0.1 micrometers. The proeutectoid carbides were evenly distributed within the pearlite matrix as very fine particles. FIG. 1 illustrates this microstructure.

The mechanical properties of the steel were measured at ambient temperature. The hardness of the steel at ambient temperature was 50 Rockwell C, with a ductility of 8 percent and a tensile strength of 230,000 pounds per square inch (psi). The 0.27 inch thick plate could be cold rolled to a reduction of over 40 percent with no visible edge cracking.

EXAMPLE 2

A piece of the hot and warm worked, air cooled and cold rolled steel of Example 1 was spheroidized by heating to a temperature of about 750° C. for about 45 minutes, followed by air cooling to ambient temperature. The resulting microstructure is illustrated in FIG. 3.

EXAMPLE 3

A piece of the hot and warm worked, and air cooled steel of Example 1 was spheroidized utilizing a divorced eutectoid transformation. The steel was heated to a temperature of about 850° C. for about 5 minutes, following by air cooling. The tensile strength was 155,000 psi, with a tensile elongation of about 20 percent. This heat treated steel could then be cold rolled to over 65 percent reduction in thickness without edge cracking.

EXAMPLE 4

A piece of the hot and warm worked, and air cooled steel of Example 1 was spheroidized utilizing a divorced eutectoid transformation with associated deformation. The steel was heated to about 810° C. for 45 minutes, and then rolled in two passes, at about 40 percent reduction per pass, to a thickness of about 0.1 inches. During the second pass, the sample cooled to about 700° C., and there was no sign of edge cracking. The microstructure of this steel is illustrated in FIG. 4. The microstructure includes about 95 percent spheroidized structure, with a very fine ferrite grain size of about 2 micrometers.

EXAMPLE 5

A steel having the composition set forth in Example 1 was hot and warm worked by rolling in a manner similar to that of Example 1, but over a wider range of temperature and strain. Specifically, a 2 inch thick billet was soaked at a temperature of about 1150° C. for 4 hours and then hot and warm rolled continuously, in ten passes, while cooling from 1150° C. to 680° C., to a final thickness of about 0.16 inches. The final two of the ten passes were done below the $A_1$ transformation temperature of about 780° C. The pearlite obtained after the eighth pass was therefore deformed extensively in the range 780° C. to 680° C. The rolled plate showed no evidence of edge or surface cracking. The microstructure of this steel is illustrated in FIG. 2, wherein the directionality of the pearlite colonies resulting from deformation below the $A_1$ temperature may be seen.

The mechanical properties of the rolled sample, after cooling to ambient temperature, showed an ultimate tensile strength of 250000 psi with 6 percent elongation, and a Rockwell C hardness of 52. The unannealed sheet could be cold rolled about 20 percent before edge cracking was observed.

EXAMPLE 6

Figure 5:
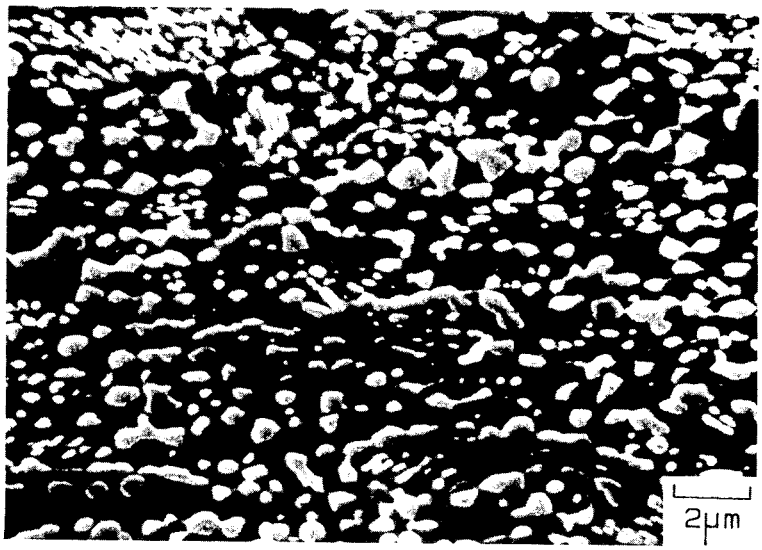
FIG. 5 is a scanning electron micrograph of an ultrahigh carbon steel containing aluminum after hot and warm working above and below the $A_1$ transformation temperature, air cooling, and reheating to below the $A_1$ transformation temperature to obtain a spheroidized microstructure.

The hot and warm worked, and air cooled, steel of Example 5 was spheroidized by reheating to a temperature of about 750° C. for 45 minutes. Essentially complete spheroidization to a very fine microstructure was observed, as illustrated in FIG. 5. Complete spheroidization below the $A_1$ temperature is believed to result from the fact that the warm working produces a high dislocation density in the pearlite, so that the pearlite readily dissolves and later recoalesces to form spherical carbides during reheating.

EXAMPLE 7

The hot and warm worked, and air cooled steel of Example 5 was spheroidized by a divorced eutectoid transformation. The steel was reheated to a temperature of 810° C. for 5 minutes and air cooled. A spheroidized, fine grained ferrite microstructure was produced.

EXAMPLE 8

The steels prepared as set forth in Examples 4–7 were observed to have superplastic behavior in tensile testing at 775° C. The following Table I presents the tensile elongation (in percent) at three different initial strain rates.

TABLE I

| Steel Produced in Example | Initial Strain Rate, percent per second | | |
|---|---|---|---|
| | .16 | 1.6 | 16 |
| 4 | * | 1311 | * |
| 5 | 1570 | 1290 | 508 |
| 6 | 1020 | 700 | * |
| 7 | 910 | 500 | * |

*no test performed

A convenient rule of thumb utilized by many engineers is that a material should exhibit superplastic elongations of about 1000 percent at a particular strain rate, and exhibit a strain rate sensitivity of at least 0.4, to be a candidate for superplastic processing operations. Table I shows that substantially superplastic behavior was reached through all processing tested at a strain rate of 0.16 percent per second. Significantly, the steels processed by the methods set forth in Examples 4 and 5 also achieved superplastic behavior at a strain rate of 1.6 percent per second. These elongations are significantly better than the best results previously obtained for ultrahigh carbon steels, which was approximately 500 percent for an ultrahigh carbon steel containing 3 percent silicon, when deformed at a strain rate of 1.6 percent per second. Thus, at least two of the processing conditions would allow superplastic processing of the ultrahigh carbon steel containing aluminum at a strain rate of 1.6 percent per second. It is particularly noteworthy that the procedures of these Examples are readily repeated on a commercial scale, and do not require complex treatments of the steel to obtain a microstructure suitable for large-strain superplastic forming.

By interpolation, it is believed that the steel of Example 5 would achieve 1000 percent elongation at strain rates of 5 percent per second. It is further believed that optimization of prior working procedures, testing and processing temperatures and aluminum content would extend the range of superplasticity to the 10 percent per second range (FIG. 6).

It will now be appreciated that the steel of the present invention provides improved forming and superplastic forming characteristics, and improved post forming properties in the end product. The steel may be formed without cracking, and may be superplastically formed at higher strain rates than previously possible with steels. The fine grain size of the steel is maintained through stabilization of fine iron carbide particles.

Although a particular embodiment of the invention has been described in detail for purposes of illustration, various modifications may be made without departing from the spirit and scope of the invention. Accordingly, the invention is not to be limited except as by the appended claims.

What is claimed is:

1. An ultrahigh carbon steel, consisting essentially of carbon in an amount of from about 0.8 weight percent up to the maximum solubility limit of carbon in austenite, aluminum in an amount of from about 0.5 up to about 10 weight percent, an effective amount of a stabilizing element acting to stabilize iron carbides against graphitization in the presence of aluminum, balance iron totalling 100 weight percent.

2. The steel of claim 1, wherein the stabilizing element is selected from the group consisting of chromium, molybdenum, and combinations thereof.

3. The steel of claim 1, wherein the stabilizing element is chromium.

4. The steel of claim 3, wherein the chromium is present in an amount of from about 0.5 up to about 2 weight percent.

5. The steel of claim 1, additionally containing about 0.5 weight percent manganese.

6. The steel of claim 1, wherein the composition is about 1.3 weight percent carbon, about 1.6 weight percent aluminum, about 1.5 weight percent chromium, about 0.6 weight percent manganese, balance iron.

7. The steel of claim 1, wherein the aluminum is present in an amount of from about 0.5 up to about 6.4 weight percent.

8. An ultrahigh carbon steel consisting essentially of from about 0.8 to about 1.5 weight percent carbon, from about 0.5 to about 10 weight percent aluminum, from about 0.5 to about 2 weight percent chromium, balance iron totalling 100 weight percent.

9. An article made by superplastically forming an ultrahigh carbon steel having a composition consisting essentially of carbon in an amount of from about 0.8 weight percent up to the maximum solubility limit of carbon in austenite, aluminum in an amount of from about 0.5 up to about 10 weight percent, an effective amount of a stabilizing element acting to stabilize iron carbides against graphitization in the presence of aluminum, balance iron totalling 100 weight percent.

10. An ultrahigh carbon steel article made by a process comprising the steps of:

preparing an alloy consisting essentially of carbon in an amount of from about 0.8 weight percent up to the maximum solubility limit of carbon in austenite, aluminum in an amount of from about 0.5 up to about 10 weight percent, an effective amount of a stabilizing element acting to stabilize iron carbide against graphitization in the presence of aluminum, minor amounts of impurity elements conventionally found in steels, balance iron totalling 100 weight percent; and processing the alloy to have an average grain size of less than about 10 microns.

11. The article of claim 10, wherein the composition of the alloy includes from about 0.8 to about 1.5 weight percent carbon, from about 0.5 to about 6.4 weight percent aluminum, a stabilizing element selected from the group consisting of chromium and molybdenum, minor amounts of impurity elements conventionally found in steels, and the balance iron.

12. The article of claim 10, wherein the stabilizing element is chromium.

13. The article of claim 10, wherein the composition of the ultrahigh carbon steel is about 1.3 weight percent carbon, about 1.6 weight percent aluminum, about 1.5 weight percent chromium, about 0.6 weight percent manganese, minor amounts of impurity elements conventionally found in steels, balance iron.

14. The article of claim 10, wherein the step of processing is accomplished by a divorced eutectoid transformation.

15. The article of claim 10, wherein the step of processing is accomplished by a divorced eutectoid transformation with associated deformation.

16. The article of claim 10, wherein the step of processing includes a step of mechanically working the alloy below the $A_1$ temperature and heat treating below the $A_1$ temperature to spheroidize the iron carbides present.

17. The article of claim 10, wherein the step of processing includes a step of mechanically working the alloy in the hot and warm working temperature range from about 1100° C. to about 700° C. to attain a fine pearlite colony size.

18. The article of claim 10, wherein the processing procedure includes the further step of:

superplastically forming the processed alloy, performed after the step of processing.

* * * * *